US008753164B2

(12) United States Patent
Hansen et al.

(10) Patent No.: US 8,753,164 B2
(45) Date of Patent: Jun. 17, 2014

(54) TOY CONSTRUCTION SYSTEM

(75) Inventors: Erik Hansen, Randbøl (DK); Gaute Munch, Langaa (DK); Tommy Christian Pedersen, Give (DK)

(73) Assignee: Lego A/S, Billund (DK)

( * ) Notice: Subject to any disclaimer, the term of this patent is extended or adjusted under 35 U.S.C. 154(b) by 925 days.

(21) Appl. No.: 12/682,443

(22) PCT Filed: Oct. 6, 2008

(86) PCT No.: PCT/EP2008/063317
§ 371 (c)(1),
(2), (4) Date: Aug. 26, 2010

(87) PCT Pub. No.: WO2009/047225
PCT Pub. Date: Apr. 16, 2009

(65) Prior Publication Data

US 2010/0311300 A1 Dec. 9, 2010

(30) Foreign Application Priority Data

Oct. 11, 2007 (DK) ..... 2007 01467

(51) Int. Cl.
*A63H 33/04* (2006.01)

(52) U.S. Cl.
USPC ..... 446/91; 446/85

(58) Field of Classification Search
USPC ..... 446/85, 91, 175, 484
See application file for complete search history.

(56) References Cited

U.S. PATENT DOCUMENTS 3,696,548 A * 10/1972 Teller ..... 446/91
4,936,185 A * 6/1990 Yamaguchi et al. ..... 84/670
5,241,250 A 8/1993 Nagasawa et al.
5,697,829 A 12/1997 Chainani et al.
6,227,931 B1 * 5/2001 Shackelford ..... 446/268
6,290,565 B1 9/2001 Galyean III et al.
6,443,796 B1 * 9/2002 Shackelford ..... 446/91

(Continued)

FOREIGN PATENT DOCUMENTS

EP 0590432 A2 4/1994
EP 1616607 A1 1/2006

(Continued)

OTHER PUBLICATIONS

International Search Report for related application No. PCT/DK2007/000244, mailed Jul. 24, 2007.

(Continued)

*Primary Examiner* — Tramar Harper
(74) *Attorney, Agent, or Firm* — Day Pitney LLP

(57) ABSTRACT

A toy construction system comprising a plurality of construction elements including one or more function construction elements for performing corresponding functions and including control connection means for communicating with one or more other construction elements; a data processing system providing a programming environment for generating one or more logic commands for controlling the one or more function elements; and an interface construction element comprising first connection means for providing a data-flow connection with the data processing system and for receiving said logic command from the data processing system, a processing unit adapted to convert said logic command into a control signal for controlling a function of said at least one function construction element, and second connection means for providing a control connection with the at least one function construction element via the control connection means of the function construction element, and for outputting the control signal.

75 Claims, 8 Drawing Sheets

(56) References Cited

U.S. PATENT DOCUMENTS

| | | | | |
|---|---|---|---|---|
| 6,585,553 | B1 * | 7/2003 | Fetridge et al. | 446/91 |
| 6,773,322 | B2 | 8/2004 | Gabai et al. | |
| 6,939,195 | B1 | 9/2005 | Hunt et al. | |
| 7,846,002 | B1 * | 12/2010 | Mikesell et al. | 446/91 |
| 2003/0175669 | A1 | 9/2003 | Mimlitch, III et al. | |
| 2004/0185745 | A1 * | 9/2004 | Reining et al. | 446/91 |

FOREIGN PATENT DOCUMENTS

| | | | |
|---|---|---|---|
| GB | 2360469 | | 1/2001 |
| JP | H05-204422 | A | 8/1993 |
| JP | H08-001564 | A | 1/1996 |
| JP | H08-103574 | A | 4/1996 |
| JP | H10-133863 | A | 5/1998 |
| JP | H11-109847 | A | 4/1999 |
| JP | H11-123676 | A | 5/1999 |
| JP | H11-195460 | A | 7/1999 |
| JP | 2000-237464 | A | 9/2000 |
| JP | 2000-237981 | A | 9/2000 |
| JP | 2006-167167 | A | 6/2006 |
| WO | 1990/09824 | A1 | 9/1990 |
| WO | 2000/41790 | A2 | 7/2000 |
| WO | WO 00/45924 | | 8/2000 |
| WO | WO 01/97937 | | 12/2001 |
| WO | 2006/042549 | A1 | 4/2006 |
| WO | WO 2006/042549 | | 4/2006 |
| WO | WO 2007/137577 | | 12/2007 |

OTHER PUBLICATIONS

International Preliminary Report on Patentability and Written Opinion for related application No. PCT/DK2007/000244, issued Dec. 3, 2008.

English translation of Notification of Reason for Refusal for corresponding JP patent application No. 2010-528371, Sep. 24, 2013.

Shibata Fumihiko, Start up the Mindstorms!, Mac Power, Japan, ASCII Corp., Sep. 1, 2006, vol. 17, No. 9, p. 116-117.

National Instruments LabVIEW 8 Delivers Ubiquitous Intelligence Function for Design, Control and Test Applications, Distinct from Express Technology—Using This New Function, Distributed System and New LabVIEW Project Development Can Be Streamlined—,[on line], Oct. 3, 2005, Business Wire, [retrieved on Sep.17, 2013], Internet <URL: http://www.businesswire.com/news/home/20051003005331/ja/>.

"Fast-track Test Development" [online], Nov. 8, 2005, Teradyne, Inc., [retrieved on Sep. 17, 2013], Internet <URL: http://web.archive.org/web/20051108115205/http://www.teradyne. co.jp/product/pro14.html>.

Yuki Shiono, Original Robot Built by Lego Brocks! Educational Lego Mindstorm NXT, Kodomo no Kagako, Seibundo Shinkosha, Nov. 1, 2006, vol. 69, No. 11, p. 34.

* cited by examiner

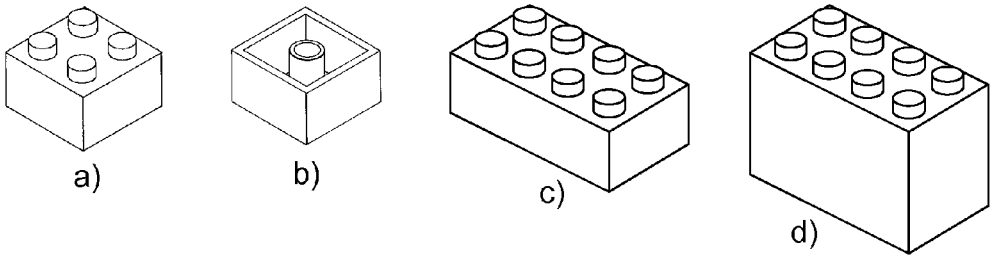
Fig. 1 - PRIOR ART
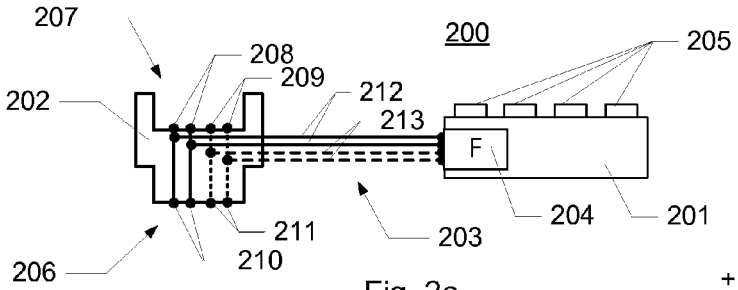
Fig. 2a
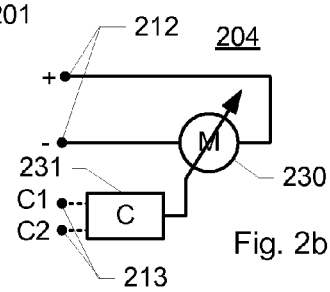
Fig. 2b
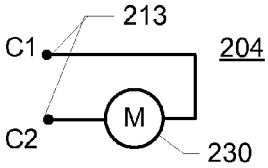
Fig. 2c
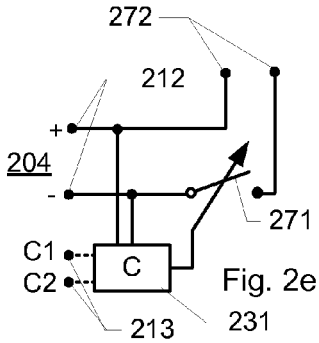
Fig. 2e
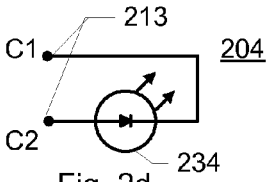
Fig. 2d
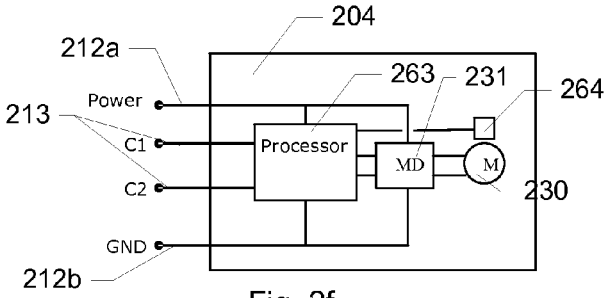
Fig. 2f

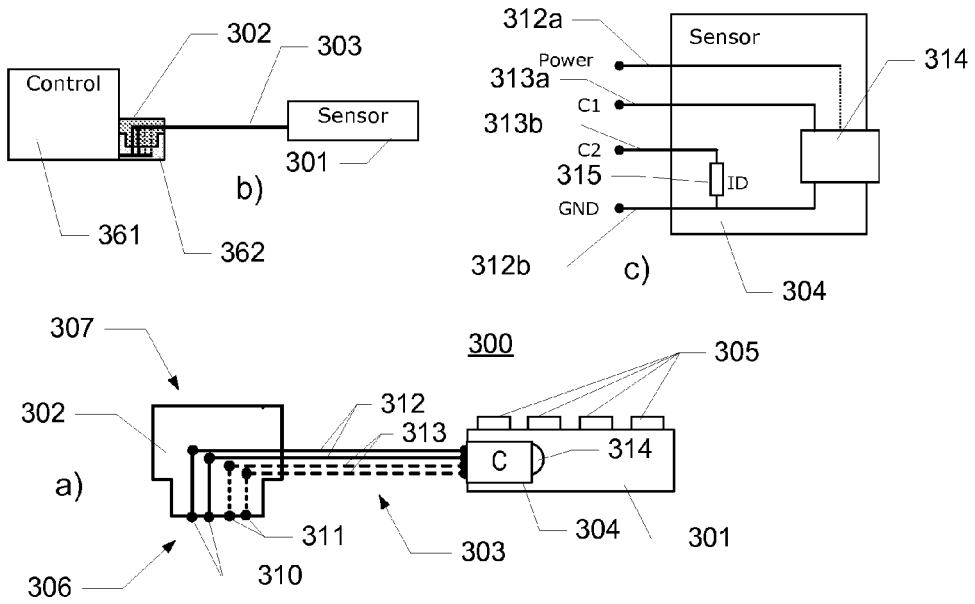
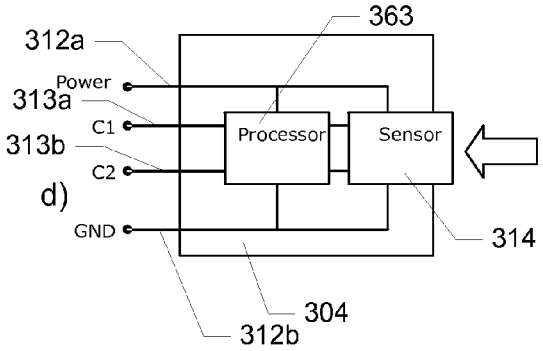
Fig. 3
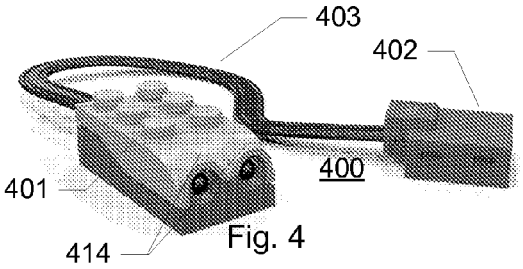
Fig. 4
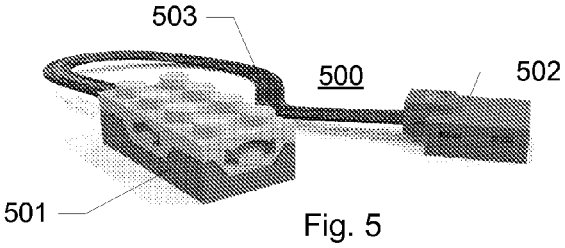
Fig. 5

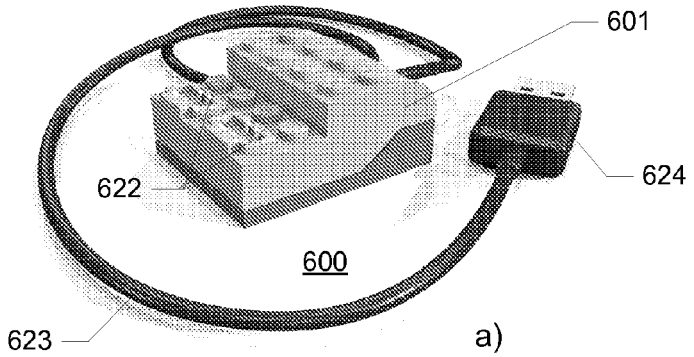
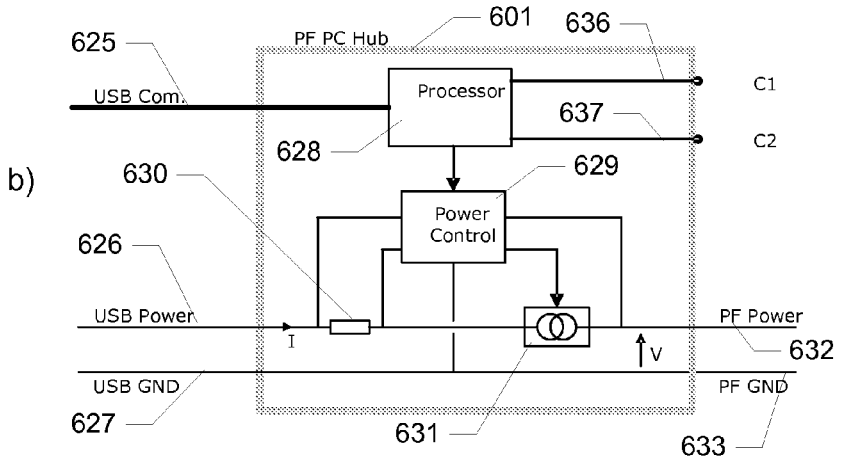
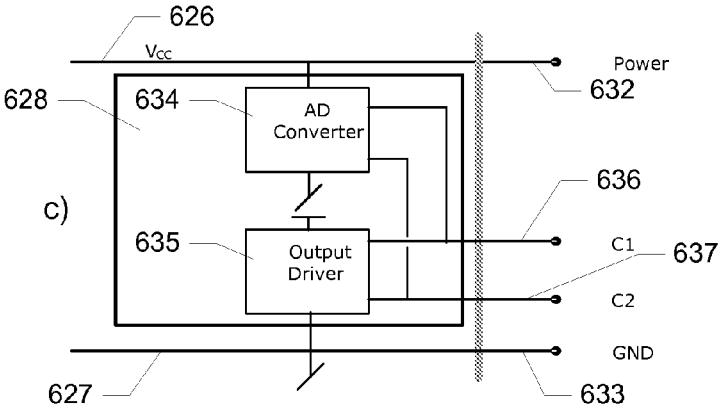
Fig. 6

TOY CONSTRUCTION SYSTEM

FIELD OF THE INVENTION

The invention relates to toy construction systems comprising construction elements with coupling means for releasably interconnecting construction elements.

BACKGROUND OF THE INVENTION

Such toy construction systems have been known for decades. The simple building blocks have been supplemented with dedicated construction elements with either a specific appearance or a mechanical or electrical function to enhance the play value. Such functions include e.g. motors, switches and lamps, but also programmable processors that accept input from sensors and can activate function elements in response to received sensor inputs.

Self-contained function construction elements exist which have a function device adapted to perform a preconfigured function, an energy source for providing energy to the function device for performing the function, and a trigger responsive to an external trigger event to trigger the function device to perform the function. Typically, such known function construction elements are designed for manual activation of the trigger and only provide a limited play value.

Toy construction systems exist that comprise a plurality of construction elements including one or more function construction elements each for performing a corresponding function, and one or more control construction elements each for controlling one or more function construction elements, each construction element including at least one connector for electrically connecting the construction element with another construction element via a corresponding connector of the other construction element, the connector including at least one control signal contact.

In order to provide an interesting play experience it is generally desirable to provide such a toy construction system which allows a user to construct a large variety of models that differ in appearance as well as functionality.

Programmable toys are known e.g. from the product ROBOTICS INVENTION SYSTEM from LEGO MINDSTORMS, which is a toy that can be programmed by a computer to perform unconditioned as well as conditioned actions.

However, it is a problem of the above prior art toy that it requires a sophisticated construction element with a central processing unit for storing and executing programs, thereby rendering the system relatively expensive.

U.S. Pat. No. 6,773,322 discloses a modular toy construction system including different input and output units. The units are connected to a transceiver/controller module which in turn communicates with a computer from which the modular units can be controlled.

However, the above prior art system requires a relatively complex configuration and programming process, and the generation of programs requires a relatively high level of familiarity with computers as well as a relatively high level of abstract cognitive capabilities in order to program a desired behaviour, thereby limiting such toys to older children and/or children being familiar with computers.

Accordingly, it is desirable to provide a toy construction system that includes functional elements that can be configured and controlled in a variety of different ways and in a manner that can easily be understood by children.

It is further desirable to provide a toy construction system with new construction elements that are suitable for use in the system, and that will enhance the play value of the system.

It is further desirable to provide a toy construction system and construction elements that are suitable for use in the system that provide a high play value without requiring high manufacturing costs.

SUMMARY OF THE INVENTION

According to a first aspect embodiments of the invention relate to a toy construction system comprising:

a plurality of construction elements including one or more function construction elements each for performing a corresponding function, each function construction element including control connection means for communicating with one or more other construction elements of the toy construction system;

a data processing system having stored thereon computer program code adapted to cause, when the computer program code is executed by the data processing system, the data processing system to provide a programming environment for generating one or more logic commands for controlling the one or more function elements;

an interface construction element comprising first connection means for providing a data-flow connection with the data processing system and for receiving said logic command from the data processing system, a processing unit adapted to convert said logic command into a control signal for controlling a function of said at least one function construction element, and second connection means for providing a control connection with the at least one function construction element via the control connection means of the function construction element, and for outputting the control signal;

wherein the interface construction element is adapted to detect at least a presence of the function construction element connected to the interface construction element; and to send information indicative of at least the presence of the connected function construction element to the data processing system; and wherein the computer program code is adapted to cause the data processing system to provide an adapted programming environment responsive to the received information about at least the presence of the connected function construction element.

The interface construction element may send the information periodically, upon request by the data processing system, and/or in another suitable way.

Consequently, a user may instantaneously start exploring the possibilities of a newly constructed structure without initially having to go through a tedious setup and configuration process. As the interface building element automatically detects the connected construction elements, the programming environment can be adapted to the connected device, e.g. so as to provide context-sensitive help, enable/disable certain functions or displays responsive to the detected construction elements etc. Consequently, even a user without great experience with computer software and hardware can easily learn how to control a constructed structure from a computer.

It is a further advantage that the interface construction element merely operates as an interface element, while all advanced logic is performed by the data processing system, thereby allowing production of the interface construction element from low-complex, inexpensive components.

When the interface construction element further detects and sends information about the type and/or operational status of the connected construction element, the programming environment may further be adapted, e.g. by displaying graphic and/or iconic representations of the connected construction elements and their respective operational status.

The first connection means may comprise a first connector for electrically connecting the interface construction element with the data processing system and for receiving said logic command from the data processing system, thereby providing a simple and reliable connection.

When the interface construction element is further configured to receive electrical power from the data processing system via the first connector, no additional power supply is required in the interface construction element.

The Connection may include a connection according to a suitable external peripheral interface standard for communication between a computer and external peripherals over a cable using e.g. bi-serial transmission, such as a Universal Serial Bus (USB) connection, a Firewire connection, or the like.

In some embodiments, the programming environment comprises a visual programming environment, thereby providing a system that is easy to use even for inexperienced users.

Generally, a visual programming language (VPL) is a programming language that lets users specify programs by manipulating program elements graphically rather than by specifying them textually. A VPL allows programming by means of visual expressions, spatial arrangements of graphic symbols and, optionally, text. Many VPLs are based on active display objects, such as iconic or symbolic elements that are interconnected, e.g. directly or by means of lines, arrows, or the like. Examples of VPLs include icon-based languages, form-based languages, and diagram languages. The term visual programming environment is intended to refer to a programming environment that provides graphical or iconic elements which can be manipulated by users so as to define a computer program or other forms of computer-executable instructions. The manipulation of the elements is typically interactive and typically follows a predetermined spatial grammar for program construction.

In some embodiments, the control connection means comprises at least one connector for electrically connecting the function construction element with another construction element of the toy construction system via a corresponding connector of the other construction element. The connector may include at least one control signal contact/terminal/port;

In some embodiments, the function construction element is a controllable function element and includes an input connector for receiving a control signal and is adapted to perform a function responsive to the received control signal; and an output connector adapted to forward the received control signal. Consequently, a plurality of function construction elements can be controlled by the data processing system via a single interface construction element, simply by connecting one function construction element to another so as obtain a sequence or chain of interconnected function construction elements. A control signal from the interface construction element fed into the first of the sequence of function construction elements is thus forwarded to all function construction elements without the need for additional wiring or programming/configuration.

The function construction element may thus include a function device adapted to perform a preconfigured function, which function may be selected from a variety of possible functions, including e.g. mechanical and/or electrical functions According to a second aspect, disclosed herein is an interface construction element for a toy construction system, the toy construction system comprising a plurality of construction elements including one or more function construction elements each for performing a corresponding function, each function construction element including at least one connector for electrically connecting the function construction element with another construction element of the toy construction system via a corresponding connector of the other construction element; the interface construction element comprising:

a first connector for electrically connecting the interface construction element with a data processing system and for receiving a logic command from the data processing for controlling one or more function construction elements of the toy construction system;

a processing unit adapted to convert said logic command into a control signal for controlling a function of said at least one function construction element, and a second connector for electrically connecting the interface construction element with one of the at least one connectors of the at least one function construction element and for outputting the control signal;

wherein the first connector is further adapted to receive electrical power from the data processing system for driving the function of the function construction element; wherein the second connector is further adapted to output the received electrical power; and wherein the interface construction element comprises a power control circuit for controlling the electrical power output by the interface construction element.

Hence, no separate power supplies, such as batteries, are required in the various construction elements, as they are all powered by the data processing system via the interface construction element. This reduces the production costs of the elements, while at the same time increasing the play value and reducing the cost of ownership, since the user does not need to purchase and replace a large number of batteries.

The provision of the power control circuit allows an open toy construction system where the user can connect a large variety and a varying number of function and other types of construction elements to the interface construction element without overloading the power supply provided by the data processing system.

According to a third aspect, disclosed herein is a toy construction system comprising:

a plurality of construction elements including one or more function construction elements each for performing a corresponding function;

one or more output construction elements each for generating an output signal; and one or more control construction elements each for controlling one or more function construction elements, each construction element including at least one connector for electrically connecting the construction element with another construction element of the toy construction system via a corresponding connector of the other construction element;

wherein each function construction element includes an input connector for receiving a control signal and is adapted to perform a function responsive to the received control signal; wherein each output construction element includes an output connector for outputting the output signal; and wherein each control construction element includes a configurable connector adapted to selectively output a control signal for controlling at least one function construction element and to receive an output signal from the at least one output construction elements. Hence, the connector of the control construction element is selectively operatable as a data input and output connector, thus allowing connecting both function construction elements and output construction elements, such as sensor construction elements, to the same connector without having to manually configure the connector as either input or output. Consequently, the risk for wiring errors in the construction of the play structure is greatly reduced, which is a great advantage in particular in relation to children who may easily get frustrated when a constructed structure does not immediately function as intended. Furthermore, the configurable connectors allow the utilisation of the same physical design for all connectors, and thus a more cost-efficient production.

The control construction element may be an interface construction element as described herein or a separate, e.g. a self-contained or autonomous, control construction element for controlling one or more function construction elements.

In some embodiments at least one output connector of a construction element includes a power contact adapted to provide output electrical power for supplying the electrical power to one or more construction elements; and wherein an input connector of each construction element includes a power contact adapted to receive electrical power and, optionally, to feed the received electrical power to the function construction element. Consequently electrical power received via the interface construction element from a data processing system as described herein may be supplied to a plurality of other construction elements.

Alternatively or additionally, a power supply construction element may be provided for providing electrical power only, or the power supply construction element may supply both electrical power and a control signal via its output connector. Hence a power supply element may further function as a control construction element.

The connectors for electrically connecting construction elements with other construction elements may be in the form of a plug or receptacle or any other suitable device for terminating or connecting the conductors of individual wires or cables and for providing a means to continue the conductors to a mating connector. To this end, the connector may include a number of contacts arranged in the connector body in a predetermined manner, i.e. a predetermined number, spacing, arrangement, etc. Each contact may be provided as any suitable conductive element configured to provide electrical contact with a corresponding contact in another connector when the connectors are mated for the purpose of transferring electrical energy and/or a control signal.

When each function construction element includes a stackable connector element including the input and output connectors of the function construction element, uniform connection means are provided that allow an easy connection of a plurality of different function, output, sensor and/or control construction elements. In particular, a uniform, stackable connector element provides uniform connection means regardless of the shape and size of the function or control construction element etc.

In particular, in one embodiment each construction element including a stackable connector includes a construction element body including an electrical circuit; and the stackable connector element is electrically connected to the electrical circuit via an extension cable, e.g. a flexible cable. Consequently, the construction element body may be placed at a position displaced from the connection point where the stackable connector element is connected to, typically a stack of stackable connector elements originating from a power supply construction element and/or an interface construction element and/or a control construction element. Consequently, a greater flexibility in the construction of a toy model is obtained. Furthermore, when the stackable connector element is connected to the construction element body of the function or control construction element by a flexible extension cable, a greater flexibility in terms of the shape and size of a construction element body as well as its placement within a toy construction model is achieved. In particular, the shape, size and placement of the construction element body are not limited by a requirement that a connector has to be accessible for connection to another connector.

When the stackable connector is adapted to receive electrical power from the input connector of the stackable connector and to feed the received electrical power to the output connector of the stackable connector element, no additional wiring is required for the distribution of separate electrical power for those function construction elements that require more power than is provided by the control signal.

In some embodiments, the stackable connector element of each function construction element is adapted to receive a control signal from the input connector of the stackable connector element, and to feed the received control signal to the function construction element and to the output connector of the stackable connector element so as to provide a direct control signal path from the input connector to the output connector. Hence, a chain of function construction elements can easily be established in a uniform manner by stacking connector elements on top of each other or in any other suitable orientation e.g. next to each other. A control construction element such as an interface construction element may thus affect all function construction elements that branch out from the output connector of the control construction element in an uninterrupted sequence/stack.

In some embodiments, the plurality of construction elements of a toy construction system further comprises one or more sensor construction elements each comprising one or more input interfaces and/or sensors responsive to a physical event; and each comprising output connection means for communicating with one or more other construction elements of the toy construction system and for outputting an output signal indicative of a detected physical event. The input interface and/or sensor may comprise any suitable circuitry, device or arrangement suitable to detect an input from a user or another device, to sense a property of the environment, or the like.

Examples of such activation interfaces/sensors include a push button, a slide, or other mechanical switch, a vibration sensor, a tilt sensor, a touch sensor, an impact sensor, a light sensor, a proximity detector, a thermometer, a microphone, a pressure sensor, a pneumatic sensor, a bus bridge, an inductive input, e.g. an input that is activated by a tag, a radio receiver, a camera, a receiver of a remote control system, e.g. an infrared remote control, etc., or a combination thereof. Hence, a simple and modular mechanism for initiating user-defined functions is provided, thereby providing a variety of interesting play scenarios.

In some embodiments, the toy construction system further includes an extension element, the extension element comprising a stackable connector element, a further output connector, and an electrical extension element, such as an extension cable/wire. The stackable connector element includes an input connector and an output connector, and the stackable connector element of the extension element being adapted to receive a control signal from the input connector of the stackable connector element, and to feed the received control signal to the further output connector via the electrical extension element and to the output connector of the stackable connector element. Consequently, the extension element may be used as an extension cable and/or for branching out a parallel stack/sequence of function and/or control construction elements.

When the function, output, sensor, control, and/or interface construction elements described herein have coupling means for releasably interconnecting the construction elements with other construction elements, they are compatible with the toy construction system and can be used together with other construction elements. The invention is generally applicable to toy construction systems with construction elements having coupling means for releasably interconnecting construction elements. Furthermore, when the connectors of the of the construction elements described herein are configured such that the input connectors are connectable only to output connectors and output connectors are connectable only to input connectors, a mechanical coding is provided that ensures correct wiring/connection of the connectors so as to avoid malfunction, short circuits, and/or the like. For example, such a mechanical coding may be provided by the form of the connector, the contact arrangement in the connector, the form of contacts, by the provision of additional coupling means, and/or the like.

It is noted that the toy building sets may comprise further types of construction elements, such as passive construction elements without any electrical connectors and without capabilities of performing or controlling actions/functions, such as conventional building blocks known in the art.

The different aspects of the present invention can be implemented in different ways including the toy building sets described above and in the following and further product means, each yielding one or more of the benefits and advantages described in connection with at least one of the aspects described above, and each having one or more preferred embodiments corresponding to the preferred embodiments described in connection with at least one of the aspects described above and/or disclosed in the dependant claims. Furthermore, it will be appreciated that embodiments described in connection with one of the aspects described herein may equally be applied to the other aspects.

In particular, a method is provided for providing a programming environment for programming a toy construction system as described herein. Furthermore, a computer program product is provided comprising program code means adapted to cause, when executed on a data processing system, to provide a programming environment for programming a toy construction system as described herein.

The computer program product may be provided as a computer-readable medium, such as a CD-ROM, DVD, optical disc, memory card, flash memory, magnetic storage device, floppy disk, hard disk, etc. In other embodiments, a computer program product may be provided as a downloadable software package, e.g. on a web server for download over the internet or other computer or communication network.

The data processing system may include any suitable computer or other processing device, such as a PC, a portable or handheld computer, a PDA, smart phone, and/or the like.

Here and in the following, the terms processing means and processing unit are intended to comprise any circuit and/or device suitably adapted to perform the functions described herein. In particular, the above term comprises general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

Consequently, a building set is provided with function and control construction elements that are interconnectable by a corresponding set of connectors according to a predetermined connection architecture. The building set allows a user to construct a large variety of functions and functional relationships in a uniform manner and with a limited set of different construction elements. Furthermore, according to some embodiments, the user may control the constructed structures from a data processing system in an easy manner. The toy construction set described herein has proven very useful in educational context, e.g. when implementing learning scenarios where simple structures constructed from toy construction elements are programmed and controlled from a computer.

BRIEF DESCRIPTION OF THE DRAWINGS

FIG. 1 shows prior art toy building bricks.

FIG. 2 schematically shows examples of a function toy construction brick.

FIG. 3 schematically shows examples of a sensor construction element.

FIGS. 4 and 5 show examples of sensor construction elements.

FIG. 6 shows an example of an interface construction element.

DETAILED DESCRIPTION OF THE INVENTION

Figure 7:
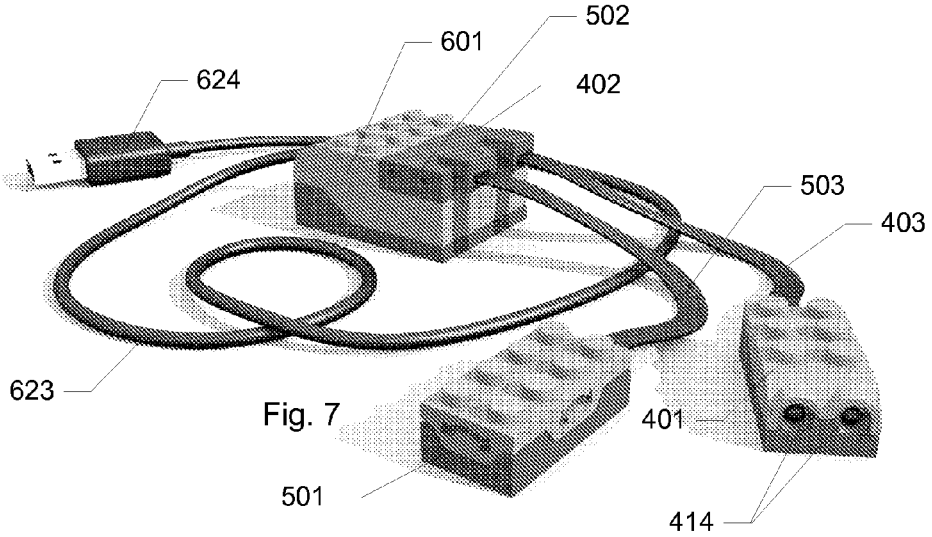
FIG. 7 shows an example structure where a tilt sensor and a proximity detector are connected to respective connectors of an interface brick.

Embodiments of the invention will mainly be described using toy construction elements in the form of bricks. However, the invention may be applied to other forms of construction elements used in toy building sets.

FIG. 1 shows examples of toy building bricks each with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 1*a-b* show perspective views of an example of such a toy building brick including its top and bottom side. FIGS. 1*c* and 1*d* show other such prior art building bricks. The building bricks shown in the remaining figures have this known type of coupling means in the form of cooperating studs and cavities. However, other types of coupling means may also be used.

FIG. 2 schematically show examples of a function construction element.

FIG. 2*a* schematically shows a function construction element, generally designated 200, including a main function construction element body in the form of a function brick 201, and a stackable connector 202 connected to the function brick 201 via flexible cable 203 including wires 212 and 213. The function brick has coupling studs 205 on its top surface and a corresponding cavity in its bottom surface (not explicitly shown). The function brick 201 includes a function device 204 that receives electric power via terminals 210 of the stackable connector 202 and wires 212 of the extension cable 203, and a control signal via terminals 211 of the stackable connector 202 and lines 213 of the extension cable 203, as will be described in more detail below, and the electrical function device 204 performs a preconfigured function, e.g. a mechanical or an electrical function. In one embodiment, the control signals may each have binary values 0 and 1, respectively.

Examples of a preconfigured mechanical function that the function construction elements described herein can perform include movements/motion such as by driving a rotating output shaft, winding-up a string or a chain which enables pulling an object closer to the function brick, fast or slow moving a hinged part of the function brick which enables e.g. opening or closing a door, ejecting an object, etc. Such mechanical motions can be driven by an electric motor as illustrated in FIG. 2*b*. FIG. 2*b* shows a wiring diagram of an example of a function device 204 that includes a motor 230 driven by the received electrical power via lines 212. The motor 230 is controlled by a control circuit 231 in response to the control signals C1, C2 received via lines 213.

It will be appreciated that the motor may be driven by the power from the power lines 212 or directly by the control signals C1 and C2, as illustrated by FIG. 2*c*. The separate power supply via lines 212 allows a supply in such a way that the polarity of the voltage is constant and well-defined.

FIG. 2*c* schematically shows a wiring diagram of another example of a function device 204 including a motor 230 that is controlled and driven by the control signals C1, C2. Hence, in this example, the function device does not receive separate electric power via lines 212, as the control signal is sufficient to operate the motor.

Examples of a preconfigured electrical function that the function construction elements described herein can perform include operating a switch with accessible terminals, generating a visible light signal, emitting constant or blinking light, activating several lamps in a predetermined sequence, generating an electrical signal, generating an invisible light signal, emitting audible sound such as beep, alarm, bell, siren, voice message, music, synthetic sound, natural or imitated sound simulating and stimulating play activities, recording and playback of a sound, emitting inaudible sound such as ultrasound, emitting a radio frequency signal or an infrared signal to be received by another component, etc. or combinations of the above.

The function bricks may have a preconfigured function, but functions may also be programmed or otherwise determined or influenced by the user.

FIG. 2*d* schematically shows a wiring diagram of an example of a function device 204 including an LED 234 that is controlled and driven by the control signals C1, C2. Hence, in this example, the function device does not receive separate electric power via lines 212, as the control signal is sufficient to operate the LED. Alternatively, the LED may be driven by the power received via lines 212 via a switch controlled by control signals C1 and or C2.

In FIG. 2*e* is illustrated that the function device 204 can be a switch 271. The switch 271 can be a normally open or a normally closed switch, and its terminals 272 can be connected to the coupling studs on the top surface or to the surfaces in the cavity that are intended for engaging coupling studs on other building bricks. The switch is controlled by the control signal received via lines 213 via logic circuit 231 as described above. When the switch 271 is closed, the voltage on power lines 212 is applied to the terminals 272. The logic circuit 231 further receives electrical power from power lines 212.

FIG. 2*f* illustrates that the function construction element may be an intelligent construction element including a microprocessor or other processing device/logic unit, e.g. a function device that provides feedback such as feedback on its operational status. In particular, FIG. 2*f* illustrates a block diagram of an example of a function device 204 including a motor 230 driven by the received electrical power via lines 212*a,b*. The motor 230 is controlled by microprocessor 263 via a control circuit/motor driver 231 in response to the control signals received via C1 and C2 designated 213. The function device further comprises an encoder unit 264 or other device for measuring the speed of the motor. The signal from encoder 264 is returned to the microprocessor, which may translate the encoder signals into a signal indicative of the speed of the motor. The microprocessor outputs the determined speed via C1 and C2, e.g. periodically or in response to a corresponding request signal received via C1 and C2. Hence, the function device of FIG. 2*f* is an example of a motor brick that includes a speedometer function.

Generally, the function device may interpret the control signals in different ways. In one embodiment, the control signals C1 and C2 may each have binary values 0 and 1, respectively, e.g. represented by two voltage levels "high" and "low" or "on" and "off". For example, in the example of FIG. 2*c*, the motor 230 may be controlled according to the following table:

| Control signal value | Motor control |
|---|---|
| (C1, C2) = (0, 0) | Motor OFF |
| (C1, C2) = (1, 0) | Motor ON Forward |
| (C1, C2) = (0, 1) | Motor ON reverse |
| (C1, C2) = (1, 1) | Motor Break |

In another example where the function device includes a sound generator configurable to play two different sounds, the function device may be adapted to play a selected one of the sounds responsive to e.g. a rising flank (i.e. a transition from 0 to 1) of the individual control signals C1 and C2 respectively, e.g. according to C1 0→1 play sound 1

C2 0→1 play sound 2.

Hence, in general, the function device may include any suitable mechanical and/or electrical device, arrangement or circuitry adapted to perform one or more of the above or alternative functions. Examples of function devices include a light source such as a lamp or LED, a sound generator, loudspeaker, sound card, or other audio source, a motor, a gear, a hinged part, a rotatable shaft, a signal generator, a valve, a pneumatic control, a shape-memory alloy, a piezo crystal, an electromagnet, a linear actuator, a radio, a display, a microprocessor, and/or the like.

The stackable connector element 202 includes both a male input connector 206 and a female output connector 207. The connectors are positioned on opposite sides of the connector element, so as to make the connector element stackable. In particular, in the present example, the male input connector is positioned on the bottom side, while the female connector is positioned on the upper side of the stackable connector element. The input and output connectors include four contacts each, designated 210, 211, and 208, 209, respectively. The contacts 210 for receiving electrical power are connected to the corresponding output contacts 208 and to the function device 204 via lines 212. The contacts 211 for receiving control signals are connected to the corresponding output contacts 209 and to the function device 204 via lines 213. It is generally preferable that the input and output connectors 206 and 207 are mechanically coded so that the contacts are always connected to the correct corresponding contacts of the corresponding other connector.

When all function construction elements of a toy building set include corresponding stackable connector elements providing and forwarding control and power input in a uniform manner, such function bricks may easily be interchanged within a toy construction built from the building bricks described herein. For example, a function brick including a lamp may simply be replaced by a function brick including a sound source or loudspeaker, without having to change any other part of the construction, since both function bricks are activated in the same way.

It is further understood that each construction element may use one or more of the input contacts in its input connector. For example, as described herein, some function construction elements may only use the control signals while other function construction elements may use both the electrical power and the control signals. It is further understood that the connector element may include further contact points, e.g. signal lines for providing a communication bus between construction elements including microprocessors.

FIG. 3 schematically shows examples of a sensor construction element.

FIGS. 3*a-c* show a first example of a sensor construction element, generally designated 300, including a main sensor construction element body in the form of a sensor brick 301, and an output connector 302 connected to the sensor brick 301 via flexible cable 303. The sensor brick has coupling studs 305 on its top surface and a corresponding cavity in its bottom surface (not explicitly shown). The sensor brick 301 includes a sensor circuit 304 that receives electric power via terminals 310 of the connector 302 and lines 312*a,b* of the extension cable 303. The sensor circuit 304 further includes a sensor element 314 for receiving a sensor input such as an external input.

In general, the sensor bricks described herein may include one or more sensor elements responsive to a physical event, e.g. an external physical event. Examples of such physical events comprise mechanical forces, push, pull, rotation, human manipulation, touch, proximity of an object, electrical signals, radio frequency signals, optical signals, visible light signals, infrared signals, magnetic signals, temperature, humidity, radiation, etc. and combinations thereof.

FIG. 3*b* shows the sensor brick 301 connected to a control construction element 361, e.g. an interface construction element as described herein, via an input connector or a configurable connector 362 of the control construction element 361.

FIG. 3*c* schematically shows a more detailed block diagram of the sensor circuit 304 of a sensor construction element. The sensing element 314 receives power from lines 312*a,b* and is connected to line 313*a* labelled C1 for providing an output signal. It will be appreciated that some sensing elements may not require connection to power lines 312*a,b*. The sensor circuit further comprises an ID resistor connecting ground (line 312*b*) with output line 313*b* labelled C2. In one embodiment, each type of sensor construction element has a respective ID resistor value, thereby allowing the control construction element 361 to measure the impedance of resistor 315 and thus to identify the type of sensor construction element connected to it. Alternatively another type of identification circuit may be used. For example, the sensor construction element may provide a second sensor output which outputs the sensor's ID.

The sensor brick 301 thus generates a sensor signal on C1 in response to sensed physical event and feeds the sensor signal to the contacts 311 of the connector element 302 via lines 313 of the extension cable 303. The connector element 302 is similar to the stackable connector element described above in that the male connector 306 has the same physical dimensions as the male connector of the stackable connector described above and has input contacts 310 for electrical power. However, contacts 311 of the male connector 306 are output contacts for output signals, and the connector element 302 does not include any female output connector.

By providing sensor construction elements with non-stackable connectors, a reliable identification of sensor elements via an ID resistor is ensured. In some embodiments sensor elements with stackable connectors and without ID resistor or with a more complicated identification scheme may be provided. However, it has turned out that the provision of sensor construction elements with ID resistors and non-stackable connectors provides a cost-effective solution that provides a high play value.

FIG. 3*d* illustrates that the sensor construction element may be an intelligent construction element including a microprocessor or other processing device/logic unit. In particular, FIG. 3*d* illustrates a block diagram of an example of a sensor circuit 304 including a sensor element 314 and a microprocessor 363. The microprocessor 363 and, optionally, the sensor element 314 receive electrical power via lines 212*a,b*. The microprocessor is further connected to C1 and C2 designated 213 via which the microprocessor can receive and/or send signals. For example, the microprocessor may receive configuration signals and/or requests for data via C1 and C2, such as ID data, sensor results and/or the like. Accordingly, the sensor may output an ID and/or the sensor results via C1 and C2, e.g. upon receive of a corresponding request or according to another suitable protocol.

FIGS. 4 and 5 show examples of sensor construction elements. In particular, FIG. 4 shows a proximity detector comprising a sensor brick 401, a connector 402 connected to the sensor brick 401 via a flexible cable 403, and a sensing element 414 in the form of a light emitting diode and a light sensor. Hence, when the LED illuminates a surface close to the LED/light sensor pair, the light sensor detects the light reflected by the surface. FIG. 5 shows a tilt sensor comprising a sensor brick 501, a connector 502 connected to the sensor brick 501 via a flexible cable 503, and a sensing element (not explicitly shown) arranged inside brick 501 and adapted to detect a tilting of the brick 501 along one or two predetermined axes.

FIG. 6 shows an example of an interface construction element. In particular, FIG. 6*a* shows a perspective view of the interface construction element, FIG. 6*b* shows a block diagram of the power control circuit of interface construction element, and FIG. 6*c* shows a block diagram of the port configuration circuit of the interface construction element.

The interface construction element generally designated 600 includes a main interface construction element body in the form of an interface brick 601, and a USB connector 624 connected to the interface brick 601 via flexible cable 623. The interface brick 601 has coupling studs on its top surface and a corresponding cavity in its bottom surface (not explicitly shown).

The interface brick 601 includes two configurable female connectors 622 that selectively function as input and output connectors as described herein. The interface brick 601 includes a processing unit 628 or other control device that feeds and outputs control signals to the corresponding contacts 636 labelled C1 and 637 labelled C2 of the connector 622. The processing unit 628 of the control brick is further adapted to communicate via the USB communication line 625 of the USB connector 624 with a data processing system (not shown in FIG. 6.)

The control brick 601 is further adapted to receive electrical power from a data processing system via USB power lines 626 and 627 of the USB connector 624. The control brick 601 feeds the received electrical power to the corresponding output contacts 632 and 633 of the connector 622, thereby providing power to one or more construction elements connected to the configurable connectors 622 of the interface construction element. The output power provided by the interface construction element 600 may be a low-voltage electric power suitable for a toy construction set, e.g. a power of between 4.5V and 9V.

The configurable connectors 622 are similar to the female connectors 207 of the function construction elements described above and each includes contacts for electrical power and control contacts for receiving and/or outputting control signals. The configurable connectors 622 are designed to mate with male connectors of both the function construction elements and the sensor construction elements described above.

The interface brick 601 includes two configurable connectors 622, each providing electrical power and outputting/receiving control signals. It will be appreciated that other embodiments of interface bricks may include a different number of connectors. The control signals fed to or received by the configurable connectors may be identical or different. Hence, the interface construction element 601 may control two parallel function construction elements or stacks of function construction elements, or the interface construction element may receive input signals from two sensor construction elements, or it may receive via one of the connectors input from a sensor construction element and output via the other connector control signals for controlling one or more function construction elements. Hence, in a toy construction built with bricks as described herein, several function and/or sensor bricks can be used interchangeably, and a particular interface brick can be used in several constructions for receiving input from sensor bricks and controlling function bricks in a uniform manner.

FIG. 7 shows an example structure where a tilt sensor 501 and a proximity detector 401 are connected to respective connectors of an interface brick 601.

Again referring to FIG. 6, the power supply available via the connectors 622 is entirely driven via the USB connection 623, 624 from a computer, e.g. a PC, to which the interface construction element is connected, thereby avoiding the need for batteries which lowers the price, size and complexity of the system.

The toy construction system described herein is an open electric building system, as the user can construct virtually endless construction combinations of construction elements. Each combination may use a different amount of electrical power.

To accommodate this freedom of construction, the interface construction element 601 comprises a power control circuit 629 for providing power management of the USB connection.

The USB specification provides a 5 V supply on a single wire from which connected USB devices may draw power. The specification provides for no more than 5.25 V and no less than 4.75 V (5 V±5%) between the positive and negative bus power lines. A device may draw power from the USB connection in two power modes and a USB device may be suspended:

High power mode (max. 500 mA)

Low power mode (max. 100 mA)

Suspend mode (max. 400 μA).

Since the interface construction element is open-ended to the toy construction system, it controls how much power is drawn and also secures that no current is sent back through the USB connection. This could e.g. happen when a motor is connected to the interface construction element is turned by an external force and acts as a generator.

To accommodate this, the power control circuit 629 is configured via the processing unit 628 and the USB communication interface 625 to the USB power mode needed. During subsequent operation, the power control circuit 629 monitors both the current I drawn from the USB power connection 626 and the voltage V at the output of the interface control element. The current I is measured as a voltage drop over a resistor 630. If the current I exceeds the current specified by the selected power mode, the power control circuit controls a current generator circuit 631 or another circuit for regulating the current I so as to limit the current drawn on the output(s) 632, 633 of the interface construction element.

If the voltage V exceeds the specified limit (e.g. when a connected motor acts as generator) the power control circuit completely blocks the power output via output connectors 632, 633.

As mentioned above, each of the configurable connectors/ports 622 enables the interface construction element 601 to receive sensor input and to provide control output from the same port. To this end, the processing unit 628 comprises an analog-to-digital (AD) converter 634 and an output driver circuit 635, both connected to the contacts 636 marked C1 and 637 marked C2.

The interface construction element reads input using the AD Converter 634 on C1 and C2. An example of a construction element from which the interface construction element can read input from is the sensor construction element described above. The AD converter converts the received input into a digital signal which is forwarded via the USB communication connection 625 to a computer.

Similarly, when the interface construction element receives control logic commands from a computer via the USB communication connection 625, the output driver 635 converts the logic commands into a suitable control signal, e.g. as described above, and outputs the generated control signal via outputs C1 and/or C2.

The configuration of the configurable ports 622 is performed based on logic commands received from the computer, which in turn is based on the detected type of connected construction element. When any construction element is connected to one of the configurable ports of an interface construction element the interface construction element detects when a module is connected/disconnected and it identifies information about the type of module (e.g. motor, light, tilt sensor etc.). The construction element then sends the information about the type of module via connection 625 to the computer. Responsive to the received information, the computer may then send logic commands to the construction element for controlling the construction element to configure the configurable ports, e.g. by means of one or more suitable switches. In alternative embodiments, the configuration of the configurable ports may be performed by control circuitry included in the construction element.

Connection/disconnection may be detected by measuring the impedance from C1 and C2 to ground. When an element is connected the impedance falls. The type of element may be determined in different ways: For example, if the impedance between C1 and C2 is low, e.g. lower than a predetermined threshold, the connected element is determined to be a motor. In other cases the ID resistor is measured, i.e. the impedance between C2 and ground, and the value will give the type of element.

It will be appreciated that the toy construction system may further include additional control construction elements that are not connected to a data processing system and that execute control autonomously. Such control construction elements may e.g. include suitable input means, e.g. user-activated input means (e.g. push buttons, switches, a remote control input sensor etc.), or an input connector similar to the input connectors of function construction elements described herein. In this case the control construction element may be powered from a battery box integrated into or separate from the control element, or from another suitable power source. Such an autonomous control construction element may also comprise one or more configurable connectors as described above with reference to an interface construction element including a suitable control unit for detecting connected elements and configuring the ports. For example, such a control unit may be integrated in the processor of the device itself.

Figure 8:
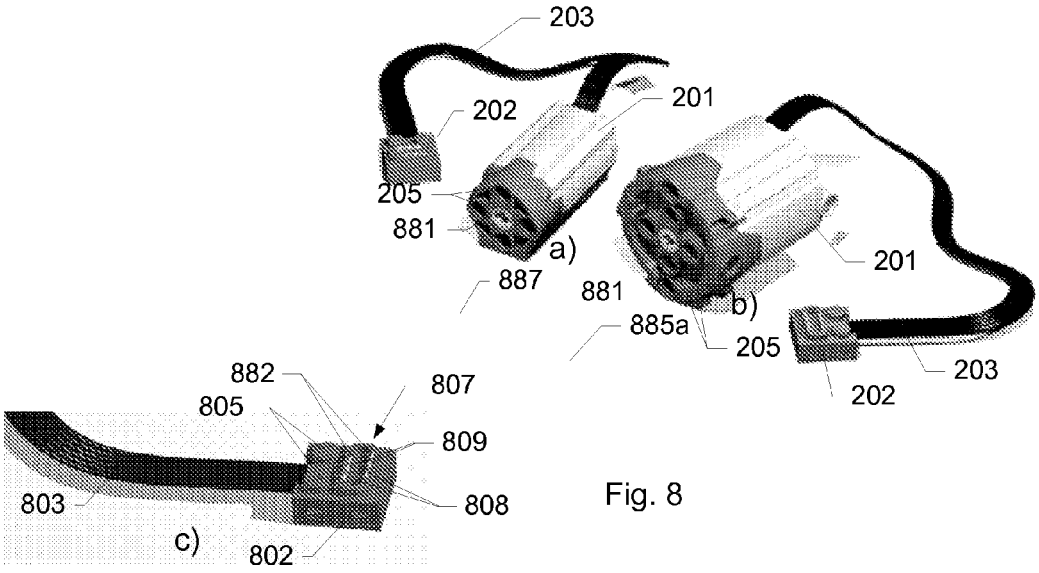
FIG. 8 show further examples of toy building bricks.

FIG. 8 shows further examples of toy construction elements.

FIGS. 8*a-b* each shows an example of a motor module 201 as an example of a function construction element. The motor module 201 includes a hole 881 for receiving a shaft to be rotated by the motor. The motor module further includes coupling means 205 for connecting the motor module with other construction elements. The motor module further includes a stackable connector element 202 as described herein.

FIG. 8*c* shows an example of a stackable connector 802 for use in the function, control, and/or extension construction elements described herein. In particular, FIG. 8*c* shows the connector element 802, the flexible extension cable 803, and the female connector 807 of the stackable connector including contacts 808 for outputting electrical power, contacts 809 for outputting control signals, and further contacts 882 for outputting additional signals, e.g. for use as a high-speed communication line for distributed intelligence. The connector element further includes coupling studs 805 for easy and reliable connection of the connector element to a male connector having one or more corresponding cavities.

Figure 9:
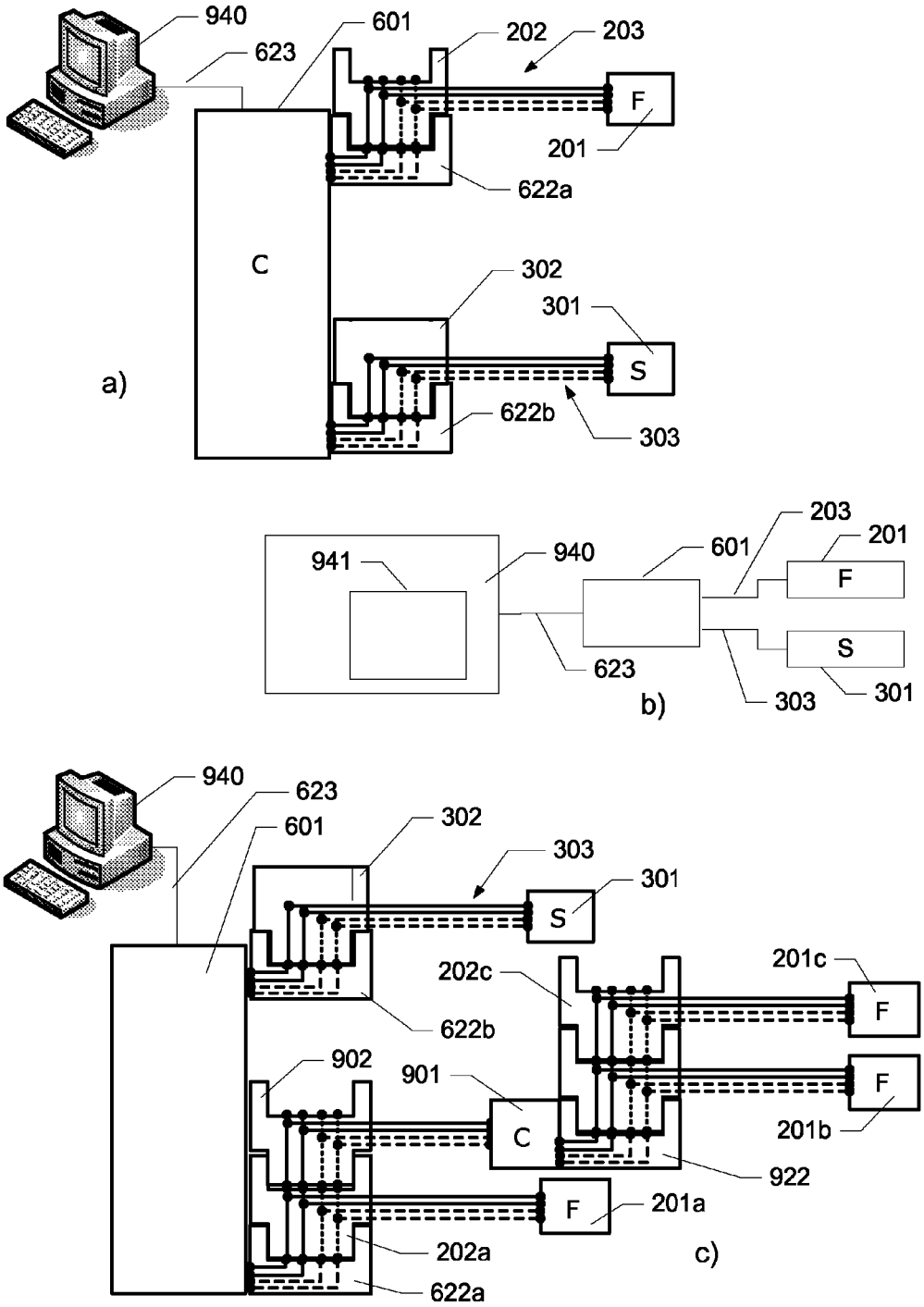
FIG. 9 shows schematic block diagrams of examples of structures constructed from a toy construction system as described herein.

FIG. 9 shows schematic block diagrams of examples of structures constructed from a toy construction system as described herein.

FIG. 9*a* shows a schematic diagram of an interface construction element connected to a data processing system, a function construction element and a sensor construction element. FIG. 9*b* shows a block diagram of the structure of FIG. 9*a*. The Interface construction element 601 is connected to the computer 940 with a USB connection 623. A software application 941 providing a programming environment executed by the computer 940 can now read data from and send control commands to the Interface construction element 623. The Interface construction element 601 has two I/O connectors 622*a* and 622*b* for connecting another construction element of the toy construction system described herein (e.g. a function, control or sensor construction element). In the example of FIGS. 9*a-b*, a senor construction element 301 is shown connected to port 622*b*, and a function construction element 201 is shown connected to port 622*a*.

As described above, the application 941 on the computer 940 receives information about when an element is connected to or disconnected from the Interface construction element 601, and what type of construction element is connected, e.g. based on a impedance measured by the interface construction element. For example, the application may receive the above information upon request, periodically or in another suitable way. The type of construction element may be function, control, or sensor element. In some embodiments, the types may be defined more fine grained, e.g. by distinguishing between different sensor types, e.g. proximity sensor, sound sensor, tilt sensor, etc., and/or by distinguishing between different function element types, e.g. motor, LED element, sound generator, etc.

This information is used to advantage by the programming application 941. The programming application 941 can now act responsive to what is connected. For example, it can configure the configurable ports of the interface construction element to input or output, enable/disable programming possibilities, give context sensitive help etc., all based on the knowledge of what is connected where. Such adaptability allows even children of relatively low age to experiment with programmable structures.

FIG. 9*c* shows a schematic diagram of another example of an interface construction element connected to a data processing system and a number of construction elements. In this example, the Interface construction element 601 is connected to the computer 940 with a USB connection 623. The Interface construction element 601 has two I/O connectors 622*a* and 622*b* for connecting another construction element of the toy construction system described herein (e.g. a function, control or sensor construction element). In the example of FIG. 9*c*, a senor construction element 301 is shown connected to port 622*a*, and a stack of construction elements is shown connected to port 622*b*.

The stack of construction elements includes function bricks 201*a-c* and a control brick 901 via their respective stackable connector elements 202*a-c* and 902. Hence, the function brick 201*a* and the control brick 901 are connected via their respective stackable connector elements in a first stack 990 originating from the interface brick 601, while function bricks 201*b* and 201*c* are connected in a second stack 991 originating from the output connector 922 of control brick 901. Thus, in this example the interface brick 601 provides power to all function and control elements in stack 990 as well as—via control brick 901—to the elements in stack 991.

The control brick 901 includes a control device (not shown) that may receive a control input from an external interface (not shown), e.g. a push button or other interface or sensor, and generates a corresponding output control signal. Furthermore, the control brick 901 includes a stackable connector element 902 having a male input connector and a female output connector. The male input connector 407 has input contacts for electrical power and output contacts connected to the input contacts. The control brick thus receives electrical power via the stackable connector element and lines 902.

The control brick further comprises a separate female output connector 922 that functions as a main output connector, as the control brick feeds its output control signal to the corresponding output contacts of the connector 922. The control brick 901 further feeds the received electrical power to the corresponding output contacts of the connector 922, thereby providing an uninterrupted power line through the system. The separate output connector may be connected to or integrated in the brick 901, or it may be arranged separate from the brick 901, e.g. connected to the brick 901 by an extension cable.

Furthermore, the stackable connector element 902 includes a connection between the control signal input contacts to the corresponding output contacts, thus providing a direct control signal path from its input to the output.

Accordingly, the control brick 901 generates its output control signal based on the input control signal and/or on the external input, e.g. by combining the two control inputs, e.g. by implementing a logic function such as an 'AND' function, an 'OR' function, and 'XOR' function, by using a change in the input control signal as a trigger event, or the like. Generally, the logic function may be a preconfigured logic function, but logic functions may also be programmed or otherwise determined or influenced by the user. In some embodiments the control device may use the input control signal and/or the external input as a trigger signal for triggering an output control signal or for triggering a control process resulting in an output control signal. For example, the control device may have stored therein an executable program, execution of which may be triggered by a predetermined input control signal and may result in an output control signal or sequence of output control signals.

Control brick 901 thus controls function bricks 201*b* and 201*c*. Furthermore, since the control brick 901 receives the control signal from its stackable connector, the interface brick 601 controls both function brick 201*a* and function bricks 201*b* and 201*c*. The latter control of function bricks 201*b* and 201*c* is performed indirectly via control brick 901 and in accordance with the specific logic function implemented by control brick 901.

It will be understood that the connector of a sensor brick may also be stacked on top of a stackable connector of a function brick that in turn is connected to a control brick, e.g. an interface brick. Stacked construction elements may influence the detection of the type of construction elements based on impedance. For example, the impedance of a motor is lower than of other elements, and connecting e.g. a light emitting function element stacked together with a motor is detected as a motor In another embodiment the control lines C1/C2 may be configured as a communication line, as will be described below, thereby allowing an improved ID detection for stacked construction elements.

FIG. 10 shows examples of user interfaces of a visual programming environment for generating, manipulating, and executing programs for a toy construction system as described herein written in a visual programming language.

Figure 10A:
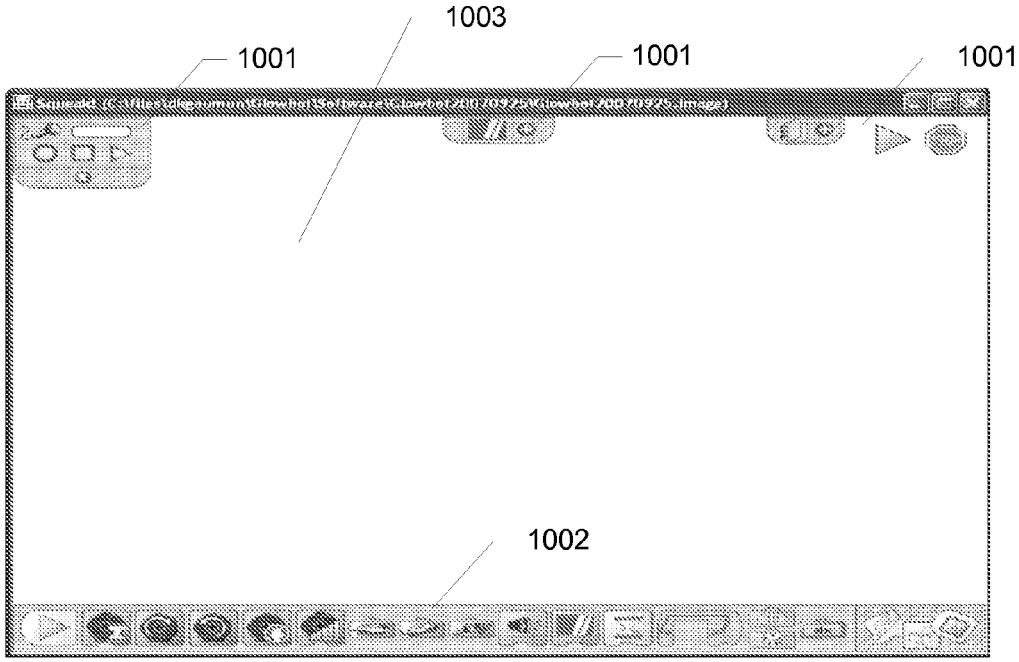
FIG. 10 shows examples of user interfaces of a visual programming environment for a toy construction system as described herein.

FIG. 10*a* shows an initial window in a situation where no construction elements are connected to the interface construction element. The user interface comprises a number of menu bars 1001 for controlling program execution, file management, help functions, and other functionality. The user interface further comprises a work space 1003 on which a user can arrange programming icons. The user may select iconic programming elements from a palette 1002 at the bottom of the screen. For example, a user may arrange the icons on the palette by means of drag-and-drop operations. Each icon represents a respective programming element, e.g. a function, a condition, a program control element, and/or the like.

Figure 10B:
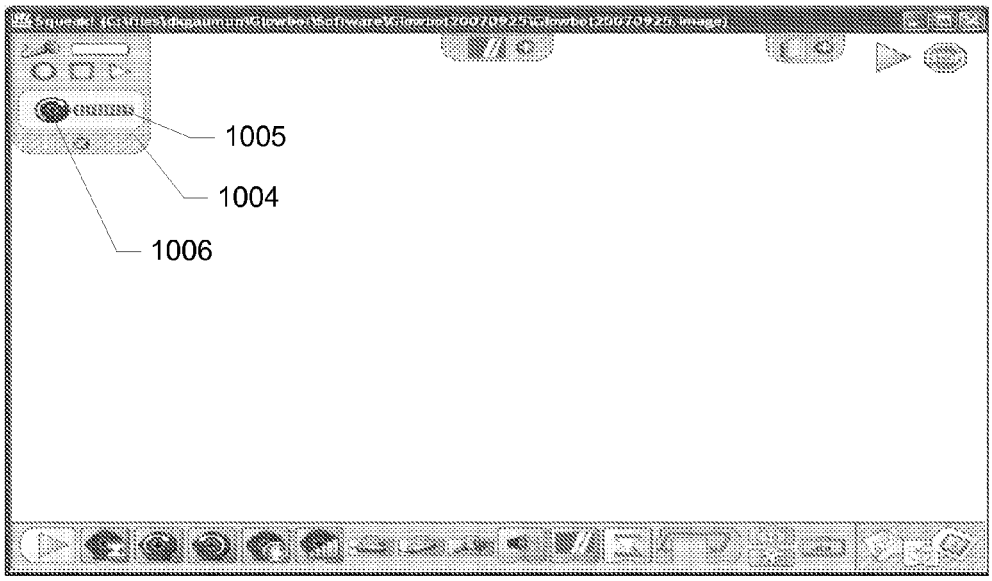

FIG. 10*b* shows the window after the user has connected a motor to one of the ports of the interface construction element connected to the computer that executes the programming environment. Responsive to the connection of the motor, the application displays a motor icon 1004 in the upper left corner of the work space. The icon indicates the type of element connected (the icon shows a turning wheel 1006) and its operational status. In this case the motor icon includes a status bar 1005, indicating the speed with which the motor rotates, and the displayed wheel 1006 indicates the direction of rotation.

Figure 10C:
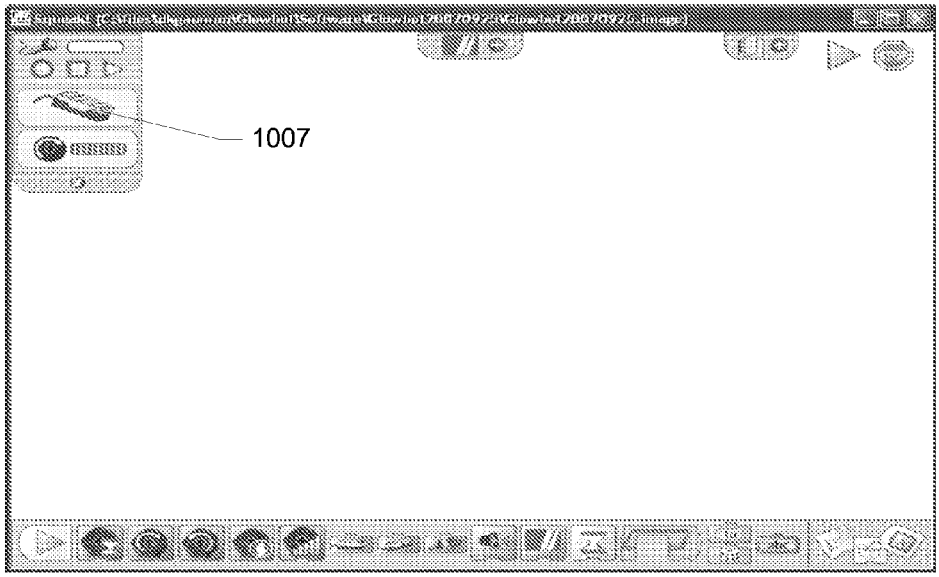

FIG. 10*c* shows the window after the user has further connected a tilt sensor to the other port of the interface construction element. Responsive to the connection of the tilt sensor, the application displays a tilt sensor icon 1007 in the upper left corner of the work space. The icon 1007 indicates the type of element connected and its operational status. In this case the icon displays a tilt sensor tilted in the detected direction.

Figure 10D:
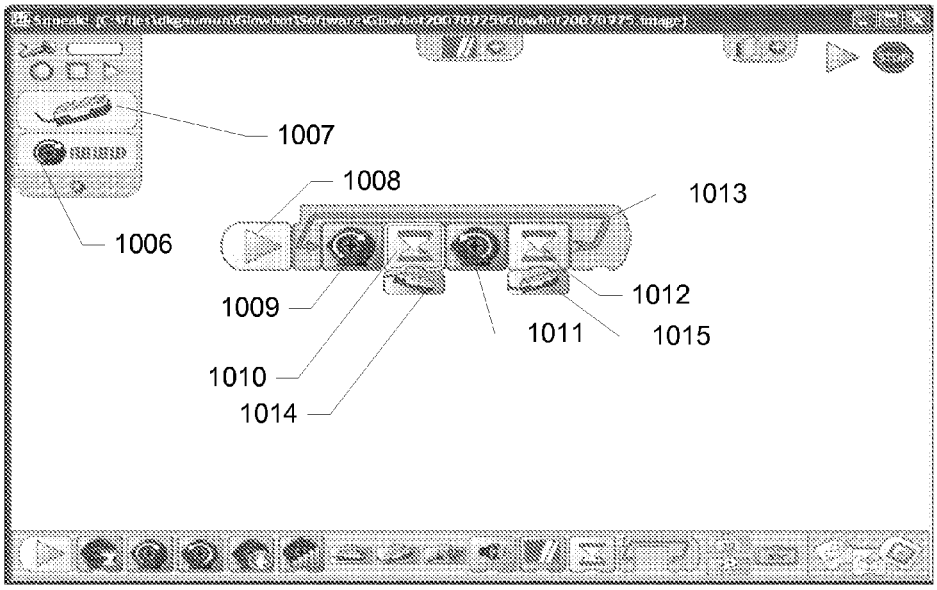

FIG. 10*d* shows the window after the user has arranged a number of program icons on the work space representative of a simple example program. The program includes a start icon 1008. When executed (e.g. by clicking on the start icon 1008), the program initially causes the computer to control the motor to run clockwise (CW) as represented by icon 1009, Then the program waits (icon 1010 represents a wait loop) until the tilt sensor is tilted forward (icon 1014 represent the condition). When the tilt sensor is tilted forward the program will change the direction of the motor to counter-clockwise (CCW) (icon 1011). Then it will wait until the tilt sensor is tilted backwards (icons 1012 and 1015). This is repeated in an infinite loop (icon 1013), e.g. until the user aborts by activating a control element in one of the menu bars 1001.

During program execution the program checks (e.g. by periodically requesting the corresponding information from the interface construction element) if any change occurs (presence/absence, type, operational status) on what is connected, thus e.g. enabling abort of a program when an element is disconnected, or visualising a status of the program execution. In the example of FIG. 10*d*, icon 1010 is emphasised by a white frame. This indicates the current position of the program execution, i.e. the program is waiting for the tilt sensor to tilt forward. Accordingly, the icons in the upper left corner indicate that the motor is running CW (icon 1006) and that the tilt sensor is tilted backward (icon 1007), i.e. consistent with the state of program execution.

In general, some embodiments of a toy construction system may comprise one or more different types of input/sensor construction elements, e.g. one or more of the following types of sensor construction elements:

- A simple resistive sensor (e.g. a sensor block for measuring touch, temperature, magnetism etc.): The ID of such a sensor may be detected by use of an ID resistor as described herein, and such a simple sensor does not require input electrical power. An example of such a sensor construction element is shown in FIG. 3*c*
- Sensor powered by a power supply (e.g. a light detector): Again, the ID of such a sensor may be detected by use of an ID resistor as described herein. An example of such a sensor construction element is shown in FIGS. 3*a-c*
- A sensor construction element with integrated logic and communication via C1/C2 (e.g. a compass, color detector, etc.): Such an element receives electrical power and uses the control lines C1 and C2 for communication with a control construction element, such as an interface construction element. An example of such a sensor construction element is shown in FIG. 3*d*

Similarly, some embodiments of a toy construction system may comprise one or more different types of output/function construction elements, e.g. one or more of the following types of function construction elements:

- Simple output function construction element powered via C1/C2 (e.g. a motor, light, etc): Examples of such elements were described in connection with FIGS. 2*c* and *d*.

A function construction element with separate power input and control (e.g. trigger) input (e.g. a sound brick): Examples of such elements were described in connection with FIGS. 2*b* and *e*.

A function construction element with integrated logic and communication via C1/C2 (e.g. a servo): An example of such elements was described in connection with FIG. 2*f*.

Figure 11:
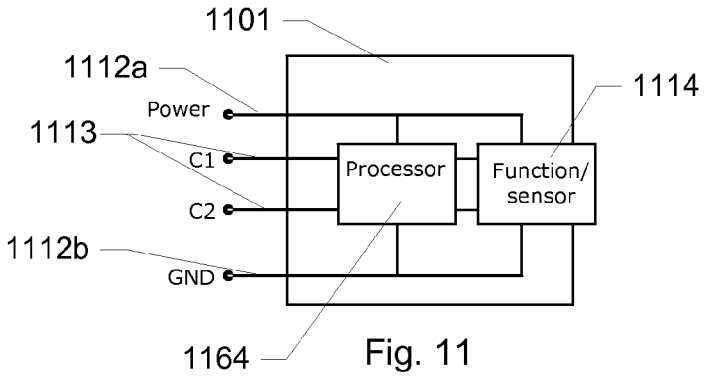
FIG. 11 shows a schematic block diagram of an intelligent construction element.

FIG. 11 shows a schematic block diagram of an intelligent construction element. The construction element 1101 may e.g. be a sensor construction element or a function construction element. The construction element 1101 includes a function/sensor element 1114 and a microprocessor 1163. The microprocessor 1163 and, optionally, the function/sensor element 1114 receive electrical power via lines 1112*a,b*. The microprocessor is further connected to C1 and C2 designated 1113 via which the microprocessor can receive and/or send signals. For example, the microprocessor may receive configuration signals and/or requests for data via C1 and C2, such as ID data, sensor results, operational feedback, and/or the like. Accordingly, the construction element may output an ID and/or the sensor results, feedback data and/or the like via C1 and C2, e.g. upon receive of a corresponding request or according to another suitable protocol.

Hence construction elements with integrated logic may implement a variety of sensor/actuator functions also with integrated control.

A construction element with integrated logic and communication uses the lines C1/C2 as communication lines allowing a control construction element, such as an interface construction element, to interface with one or more sensor/input and/or function/output construction elements. The processor in the construction element 1101 provides the communication interface. The other end of the protocol may thus be implemented in a control construction element, in an interface construction element, or in a data processing system via the interface construction element. Each construction element with integrated logic may have a unique network ID, e.g. stored in an on-chip memory. When the construction element 1101 with integrated logic includes a stackable connector element as described herein, each female plug on a control construction element such as an interface construction element provides a communication bus where multiple sensor/input and/or function/output construction elements can be connected as is illustrated in FIG. 12

Figure 12:
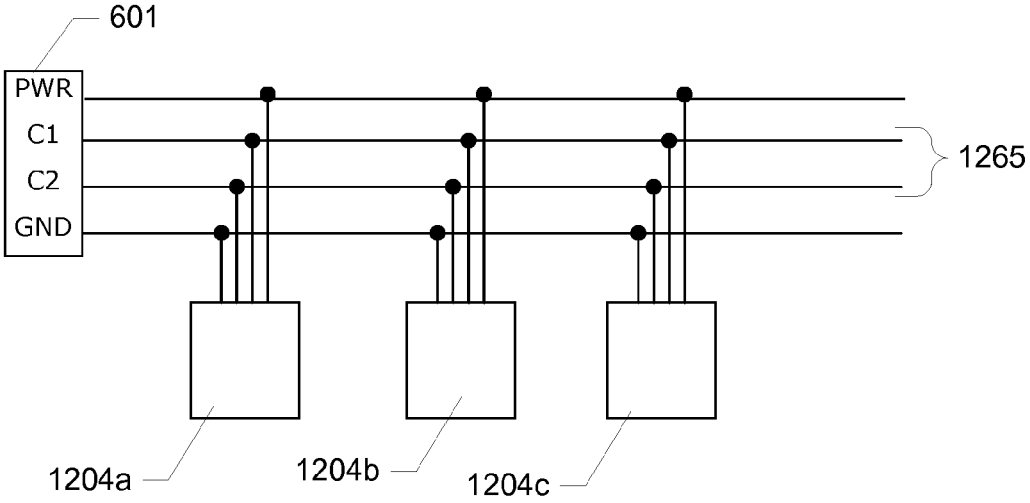
FIG. 12 illustrates a number of intelligent construction elements connected to a control construction element e.g. an interface construction element.

FIG. 12 illustrates a number of intelligent construction elements connected to a control construction element e.g. an interface construction element. In the example of FIG. 12, three construction elements with integrated logic 1204*a-c* are connected to a control construction element 601 via a two-wire bus 1265 formed by the stackable connectors (not explicitly shown) of the construction elements 1204*a-c* connected to the control construction element 601. It will be appreciated that different numbers of construction elements 1204 may be connected in the manner shown in FIG. 12.

Although some embodiments have been described and shown in detail, the invention is not restricted to them, but may also be embodied in other ways within the scope of the subject matter defined in the following claims. In the device claims enumerating several means or units, several of these can be embodied by one and the same item of hardware, e.g. a suitably programmed microprocessor or other processing unit. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A toy construction system comprising:

a plurality of releasably interconnectable construction elements including one or more function construction elements each for performing a corresponding function, each function construction element including control connection means for communicating with one or more other construction elements of the toy construction system;

a data processing system having stored thereon computer program code configured to cause, when the computer program code is executed by the data processing system, the data processing system to provide a programming environment for generating one or more logic commands for controlling the one or more function elements;

an interface construction element comprising:

first connection means for providing a data-flow connection with the data processing system and for receiving said logic command from the data processing system, a processing unit configured to convert said logic command into a control signal for controlling a function of said at least one function construction element, and second connection means for providing a control connection with the at least one function construction element via the control connection means of the function construction element, and for outputting the control signal;

wherein the interface construction element is configured to detect at least a presence of the function construction element releasably connected to the interface construction element; and to send information indicative of at least the presence of the connected function construction element to the data processing system; and wherein the computer program code is configured to cause the data processing system to provide an adapted programming environment responsive to the received information about at least the presence of the connected function construction element.

2. A toy construction system according to claim 1, wherein the control connection means comprises at least one connector for electrically connecting the function construction element with another construction element of the toy construction system via a corresponding connector of the other construction element.

3. A toy construction system according to claim 2, wherein the at least one connector for electrically connecting the function construction element with another construction element is a stackable connector element including an input and an output connector of the function construction element.

4. A toy construction system according to claim 3, wherein the stackable connector element of each function construction element is configured to receive a control signal via the input connector of the stackable connector element, and to feed the received control signal to the function construction element and to the output connector of the stackable connector element so as to provide a direct control signal path from the input connector to the output connector.

5. A toy construction system according to claim 2, wherein at least one output connector of a function construction element includes a power contact configured to provide output electrical power for supplying electrical power to one or more construction elements connected to the output connector; and wherein an input connector of each construction element includes a power contact configured to receive electrical power.

6. A toy construction system according to claim 3, wherein each construction element including a stackable connector includes a construction element body including an electrical circuit; and wherein the stackable connector element is electrically connected to the electrical circuit via a flexible cable.

7. A toy construction system according to claim 3, wherein each stackable connector element includes a first connecting side including the input connector of the stackable connector element, and a second connecting side opposite the first connecting side, the second connecting side including the output connector of the stackable connector element.

8. A toy construction system according to claim 1, wherein the second connection means comprises at least one second connector for electrically connecting the interface construction element with another construction element of the toy construction system via a corresponding connector of the other construction element.

9. A toy construction system according to claim 8, wherein the second connection means comprises two second connectors, each for electrically connecting the interface construction element with a respective other construction element of the toy construction system via a corresponding connector of the respective other construction element.

10. A toy construction system according to claim 8, wherein the at least one second connector is selectively operatable as a data input and output connector.

11. A toy construction system according to claim 8, wherein the interface construction element is further configured to supply electrical power via the at least one second connector.

12. A toy construction system according to claim 1, wherein the first connection means comprises a first connector for electrically connecting the interface construction element with the data processing system and for receiving said logic command from the data processing system.

13. A toy construction system according to claim 12, wherein the interface construction element is further configured to receive electrical power from the data processing system via the first connector.

14. A toy construction system according to claim 13, wherein the interface construction element comprises a power control circuit for controlling the electrical power output by the interface construction element.

15. A toy construction system according to claim 12, wherein the first connection means comprises a universal serial bus connection.

16. A toy construction system according to claim 1, wherein the interface construction element comprises circuitry for detecting at least the presence and type of a construction element connected to the interface construction element via the second connection means; wherein the interface construction element is configured to send information indicative of the detected presence and type of construction element to the data processing system via the first connection means; and wherein the computer program code is configured to cause the data processing system to provide an adapted programming environment responsive to the received information about at least the presence and type of construction element.

17. A toy construction system according to claim 16, wherein the circuitry for detecting at least the presence and type of a construction element comprises circuitry for detecting an electrical impedance of the construction element connected to the interface construction element via the second connection means.

18. A toy construction system according to claim 16, wherein the circuitry for detecting at least the presence and type of construction element connected to the interface construction element is further configured to detect an operational status of the connected construction element and to send information indicative of the detected operational status to the data processing system via the first connection means.

19. A toy construction system according to claim 1, wherein the plurality of construction elements further comprises one or more sensor construction element each comprising one or more input interfaces/sensors responsive to a physical event; and each comprising control connection means for communicating with one or more other construction elements of the toy construction system and for outputting a control signal indicative of a detected physical event.

20. A toy construction system according to claim 1, wherein the adapted programming environment is configured to provide an indication of at least one of the presence, type and operational status of at least one construction element connected to the interface construction element to a user of the data processing system.

21. A toy construction system according to claim 20, wherein the adapted programming environment is configured to provide context-sensitive help responsive to the presence of at least one construction element connected to the interface construction element to a user of the data processing system.

22. A toy construction system according to claim 1, wherein the programming environment comprises a visual programming environment.

23. A toy construction system according to claim 22, wherein the visual programming environment comprises iconic elements which can be manipulated by a user according to a predetermined spatial grammar for program construction; and wherein the visual programming environment is configured to enable at least a subset of the iconic elements conditioned on a detected type of a connected construction element.

24. A toy construction system according to claim 22, wherein the visual programming environment comprises iconic elements which can be manipulated by a user according to a predetermined spatial grammar for program construction; and wherein the visual programming environment is configured to change the appearance of at least a subset of the iconic elements responsive to a detected operational status of a connected construction element.

25. A toy construction system according to claim 1, wherein each function construction element is configured to receive a control signal via the control connection means of the function construction element and to perform a function responsive to the received control signal.

26. A toy construction system according to claim 1, wherein each construction element includes coupling means for releasably interconnecting construction elements.

27. A toy construction system according to claim 26, wherein each connector includes coupling means for releasably interconnecting construction elements.

28. A toy construction system according to claim 26, wherein the coupling means comprise protrusions and cavities configured to receive protrusions in a frictional engagement.

29. A toy construction product comprising:

a plurality of releasably interconnectable construction elements including one or more function construction elements each for performing a corresponding function, each function construction element including control connection means for communicating with one or more other construction elements of the toy construction product;

a computer-readable medium having stored thereon computer program code configured to cause, when the computer program code is executed by a data processing system, the data processing system to provide a programming environment for generating one or more logic commands for controlling the one or more function elements;

an interface construction element comprising first connection means for providing a data-flow connection with the data processing system and for receiving said logic command from the data processing system, a processing unit configured to convert said logic command into a control signal for controlling a function of said at least one function construction element, and second connection means for providing a control connection with the at least one function construction element via the control connection means of the function construction element, and for outputting the control signal;

wherein the interface construction element is configured to detect at least a presence of the function construction element releasably connected to the interface construction element; and to send information indicative of at least the presence of the connected function construction element to the data processing system; and wherein the computer program code is configured to cause the data processing system to provide an adapted programming environment responsive to the received information about at least the presence of the connected function construction element.

30. An interface construction element for a toy construction system, the toy construction system comprising a plurality of construction elements including one or more function construction elements each for performing a corresponding function, each function construction element including at least one connector for electrically connecting the function construction element with another construction element of the toy construction system via a corresponding connector of the other construction element; the interface construction element comprising:

a first connector for electrically connecting the interface construction element with a data processing system and for receiving a logic command from the data processing for controlling one or more function construction elements of the toy construction system;

a processing unit configured to convert said logic command into a control signal for controlling a function of said at least one function construction element, and a second connector for electrically connecting the interface construction element with one of the at least one connectors of the at least one function construction element and for outputting the control signal;

wherein the first connector is further configured to receive electrical power from the data processing system for driving the function of the function construction element; wherein the second connector is further configured to output the received electrical power; and wherein the interface construction element comprises a power control circuit for controlling the electrical power output by the interface construction element.

31. An interface construction element according to claim 30, wherein the power control circuit is configured to monitor at least one of an electrical current received from the data processing system and an electric voltage output by the interface control element, and to at least reduce an electrical current output via the second connector if the monitored electrical current or the monitored electrical voltage exceeds a respective predetermined threshold.

32. An interface construction element according to claim 31, wherein the power control circuit is configured to monitor the electrical current received from the data processing system and an electric voltage output by the interface control element, and to reduce the electrical current output via the second connector if the monitored electrical current exceeds a predetermined threshold, and to turn the electrical power output via the second connector off.

33. An interface construction element according to claim 30, wherein the power control circuit comprises a current generator.

34. An interface construction element according to claim 30, wherein the interface construction element is configured to detect at least a presence of the function construction element connected to the interface construction element; and to send information indicative of at least the presence of the connected function construction element to the data processing system.

35. An interface construction element according to claim 30, comprising at least two second connectors, each for electrically connecting the interface construction element with a connector of at least one respective function construction element.

36. An interface construction element according to claim 30, wherein the at least one second connector is selectively operatable as a data input and output connector.

37. An interface construction element according to claim 30, wherein the first connector is a universal serial bus connector.

38. An interface construction element according to claim 30, wherein the interface construction element comprises circuitry for detecting at least the presence and type of a construction element connected to the interface construction element via the second connector; and wherein the interface construction element is configured to send information indicative of the detected presence and type of construction element to the data processing system via the first connector.

39. An interface construction element according to claim 38, wherein the circuitry for detecting at least the presence and type of a construction element comprises circuitry for detecting an electrical impedance of the construction element connected to the interface construction element via the second connector.

40. An interface construction element according to claim 38, wherein the circuitry for detecting at least the presence and type of construction element connected to the interface construction element is further configured to detect an operational status of the connected construction element and to send information indicative of the detected operational status to the data processing system via the first connector.

41. An interface construction element according to claim 30, wherein the interface construction element is further configured to receive, via the second connector, a sensor signal from a sensor construction element of the toy construction system, the sensor signal being indicative of a physical event detected by the sensor construction element.

42. An interface construction element according to claim 30, comprising coupling means for releasably interconnecting the interface construction element with corresponding coupling means of one or more other construction elements of the toy construction system.

43. An interface construction element according to claim 42, wherein the second connector includes coupling means for releasably interconnecting construction elements.

44. An interface construction element according to claim 42, wherein the coupling means comprise protrusions and cavities configured to receive protrusions in a frictional engagement.

45. A toy construction system comprising:

a plurality of construction elements including one or more function construction elements each for performing a corresponding function;

one or more output construction elements each for generating an output signal; and one or more control construction elements each for controlling one or more function construction elements, each construction element including at least one control connector for electrically connecting the construction element with another construction element via a corresponding connector of the other construction element;

wherein each function construction element includes an input control connector for receiving a control signal and is configured to perform a function responsive to the received control signal; wherein each output construction element includes an output control connector for outputting the output signal; and wherein each control construction element includes a configurable connector configured to selectively output a control signal for controlling at least one function construction element and to receive an output signal from the at least one output construction elements; and wherein the control construction element comprises circuitry for detecting at least the type of a construction element connected to the control construction element via the configurable connector; and wherein the control construction element is configured to configure the configurable connector responsive to the detected type.

46. A toy construction system according to claim 45, wherein the circuitry for detecting at least the type of a construction element comprises circuitry for detecting an electrical impedance of the construction element connected to the interface construction element via the configurable connector.

47. A toy construction system according to claim 45, wherein at least one output construction element is a sensor construction element comprising one or more input interfaces/sensors responsive to a physical event, and configured to generate an output signal indicative of a detected physical event.

48. A toy construction system according to claim 45, wherein the control construction element comprises two configurable connectors, each configured to selectively output a control signal for controlling at least one function construction element and to receive an output signal from the at least one output construction elements.

49. A toy construction system according to claim 48, wherein each construction element including a stackable connector includes a construction element body including an electrical circuit; and wherein the stackable connector element is electrically connected to the electrical circuit via a flexible cable.

50. A toy construction system according to claim 48, wherein each stackable connector element includes a first connecting side including the input control connector of the stackable connector element, and a second connecting side opposite the first connecting side, the second connecting side including the output control connector of the stackable connector element.

51. A toy construction system according to claim 45, wherein the at least one control connector for electrically connecting the function construction element with another construction element is a stackable connector element including an input and an output connector of the function construction element.

52. A toy construction system according to claim 51, wherein the stackable connector element of each function construction element is configured to receive a control signal via the input connector of the stackable connector element, and to feed the received control signal to the function construction element and to the output connector of the stackable connector element so as to provide a direct control signal path from the input connector to the output connector.

53. A toy construction system according to claim 45, wherein the control construction element is further configured to supply electrical power via the configurable connector.

54. A toy construction system according to claim 45, wherein the function construction element comprises an output control connector including a power contact configured to provide output electrical power for supplying electrical power to one or more construction elements connected to the output control connector; and wherein an input control connector of each construction element includes a power contact configured to receive electrical power.

55. A toy construction system according to claim 45, wherein each construction element includes coupling means for releasably interconnecting construction elements.

56. A toy construction system according to claim 55, wherein each connector includes coupling means for releasably interconnecting construction elements.

57. A toy construction system according to claim 55, wherein the coupling means comprise protrusions and cavities configured to receive protrusions in a frictional engagement.

58. A toy construction system according to claim 45 further comprising a data processing system having stored thereon computer program code configured to cause, when the computer program code is executed by the data processing system, the data processing system to provide a programming environment for generating one or more logic commands for controlling the one or more function elements; and wherein the control construction element is an interface construction element comprising first connection means for providing a data-flow connection with the data processing system and for receiving said logic command from the data processing system, a processing unit configured to convert said logic command into a control signal for controlling a function of said at least one function construction element, and wherein the configurable connector of the interface construction element is configured to output the control signal.

59. A toy construction system according to claim 58, wherein the interface construction element is configured to detect at least a presence of the function construction element connected to the interface construction element; and to send information indicative of at least the presence of the connected function construction element to the data processing system; and wherein the computer program code is configured to cause the data processing system to provide an adapted programming environment responsive to the received information about at least the presence of the connected function construction element.

60. A toy construction system according to claim 58, wherein the first connection means comprises a first connector for electrically connecting the interface construction element with the data processing system and for receiving said logic command from the data processing system.

61. A toy construction system according to claim 60, wherein the interface construction element is further configured to receive electrical power from the data processing system via the first connector.

62. A toy construction system according to claim 61, wherein the interface construction element comprises a power control circuit for controlling the electrical power output by the interface construction element.

63. A toy construction system according to claim 62, wherein the power control circuit is configured to monitor at least one of an electrical current received from the data processing system and an electric voltage output by the interface control element, and to at least reduce an electrical current output via the second connector if the monitored electrical current or the monitored electrical voltage exceeds a respective predetermined threshold.

64. A toy construction system according to claim 63, wherein the power control circuit is configured to monitor the electrical current received from the data processing system and an electric voltage output by the interface control element, and to reduce the electrical current output via the second connector if the monitored electrical current exceeds a predetermined threshold, and to turn the electrical power output via the second connector off.

65. A toy construction system according to claim 62, wherein the power control circuit comprises a current generator.

66. A toy construction system according to claim 60, wherein the first connection means comprises a universal serial bus connection.

67. A toy construction system according to claim 58, wherein the interface construction element comprises circuitry for detecting at least the presence and type of a construction element connected to the interface construction element via the second connection means; wherein the interface construction element is configured to send information indicative of the detected presence and type of construction element to the data processing system via the first connection means; arid wherein the computer program code is configured to cause the data processing system to provide an adapted programming environment responsive to the received information about at least the presence and type of construction element.

68. A toy construction system according to claim 67, wherein the circuitry for detecting at least the presence and type of construction element connected to the interface construction element is further configured to detect an operational status of the connected construction element and to send information indicative of the detected operational status to the data processing system via the first connection means.

69. A toy construction system according to claim 58, wherein the adapted programming environment is configured to provide an indication of at least one of the presence, type and operational status of at least one construction element connected to the interface construction element to a user of the data processing system.

70. A toy construction system according to claim 69, wherein the adapted programming environment is configured to provide context-sensitive help responsive to the presence of at least one construction element connected to the interface construction element to a user of the data processing system.

71. A toy construction system according to claim 58, wherein the programming environment comprises a visual programming environment.

72. A toy construction system according to claim 71, wherein the visual programming environment comprises iconic elements which can be manipulated by a user according to a predetermined spatial grammar for program construction; and wherein the visual programming environment is configured to enable at least a subset of the iconic elements conditioned on a detected type of a connected construction element.

73. A toy construction system according to claim 71, wherein the visual programming environment comprises iconic elements which can be manipulated by a user according to a predetermined spatial grammar for program construction; and wherein the visual programming environment is configured to change the appearance of at least a subset of the iconic elements responsive to a detected operational status of a connected construction element.

74. A control construction element for a toy construction system, the toy construction system including (i) a plurality of construction elements having one or more function construction elements, each for performing a corresponding function (ii) one or more output construction elements each for generating an output signal, and (iii) said control construction elements, each control construction element including at least one control connector for electrically connecting the construction element with another construction element via a corresponding connector of the other construction element; each function construction element including an input control connector for receiving a control signal and being configured to perform a function responsive to the received control signal, each output construction element including an output control connector for outputting the output signal;

wherein said control construction element is configured to control one or more function construction elements and includes a configurable connector for electrically connecting the control construction element with another construction element via a corresponding connector of the other construction element wherein the configurable connector is operable to selectively output a control signal for controlling at least one function construction element and to receive an output signal from the at least one output construction element; wherein each control construction element comprises circuitry for detecting at least the type of a construction element connected to the control construction element via the configurable connector; and wherein each control construction element configures the configurable connector responsive to the detected type.

75. An interface construction element for a toy construction system, the toy construction system comprising a plurality of releasably interconnectable construction elements including one or more function construction elements each for performing a corresponding function, each function construction element including control connection means for communicating with one or more other construction elements of the toy construction system; the interface construction element comprising:

first connection means for providing a data-flow connection with a data processing system having stored thereon computer program code configured to cause, when the computer program code is executed by the data processing system, the data processing system to provide a programming environment for generating one or more logic commands for controlling the one or more function elements, and wherein the first connection means is configured to receive said logic command from the data processing system;

a processing unit configured to convert said logic command into a control signal for controlling a function of said at least one function construction element, and second connection means for providing a control connection with the at least one function construction element via the control connection means of the function construction element, and for outputting the control signal;

wherein the interface construction element is configured to detect at least a presence of the function construction element releasably connected to the interface construction element; and to send information indicative of at least the presence of the connected function construction element to the data processing system thereby enabling the computer program code to cause the data processing system to provide an adapted programming environment responsive to the received information about at least the presence of the connected function construction element.

* * * * *